US005306020A

United States Patent [19]

Bolf

[11] Patent Number: 5,306,020

[45] Date of Patent: Apr. 26, 1994

[54] ARROW NOCK ASSEMBLY

[76] Inventor: Robert G. Bolf, 147 Onyx, Eagle Point, Oreg. 97524

[21] Appl. No.: 69,747

[22] Filed: Jun. 1, 1993

[51] Int. Cl.[5] ..... F42B 6/06

[52] U.S. Cl. ..... 273/416

[58] Field of Search ..... 273/416, 418–423

[56] References Cited

U.S. PATENT DOCUMENTS

| | | | |
|---|---|---|---|
| 1,789,575 | 1/1931 | Allen | 273/420 |
| 2,747,876 | 5/1956 | Teller | 273/420 |
| 2,925,278 | 2/1960 | Sweetland | 273/419 |
| 4,381,866 | 5/1983 | Simo | 273/422 |
| 4,537,404 | 8/1985 | Castellano et al. | 273/422 |
| 4,856,792 | 8/1989 | Hardison | 273/416 |
| 5,178,399 | 1/1993 | Garoutte | 273/422 |

*Primary Examiner*—Paul E. Shapiro
*Attorney, Agent, or Firm*—Leon Gilden

[57] ABSTRACT

An arrow is arranged to threadedly receive a nock member, wherein the nock member is threadedly received within an associated insert coaxially positioned within the rearward distal end of the associated arrow shaft.

2 Claims, 4 Drawing Sheets

FIG. 3
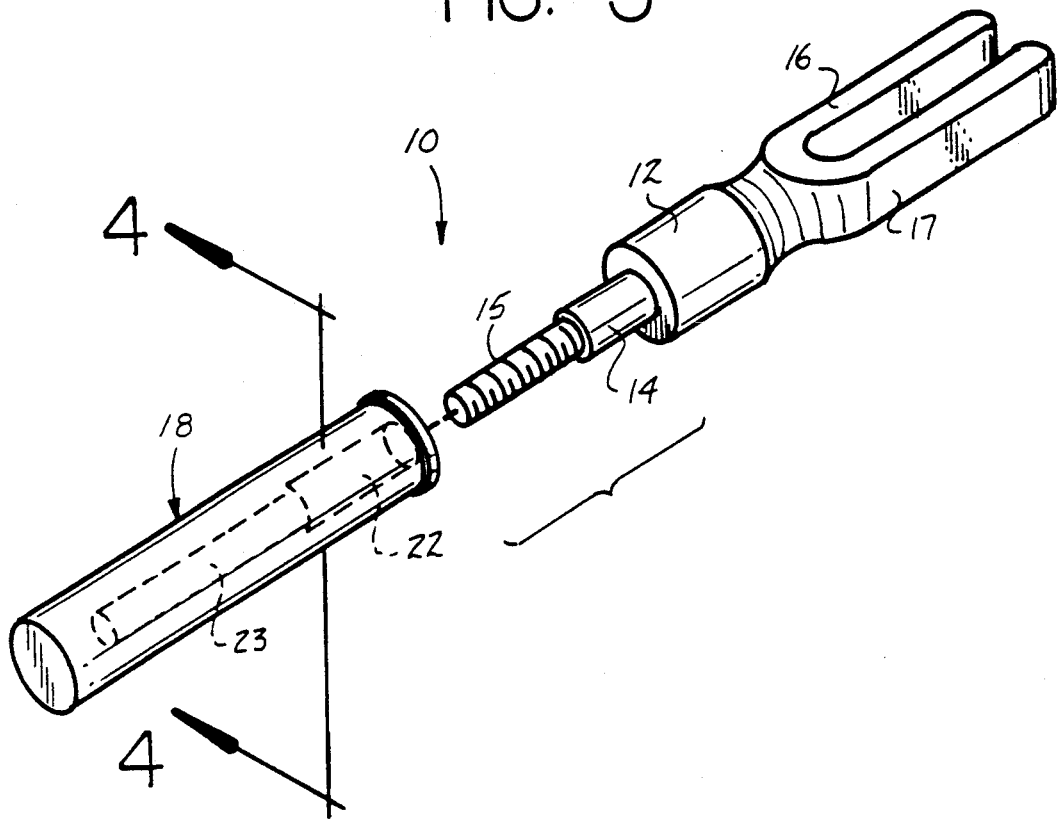
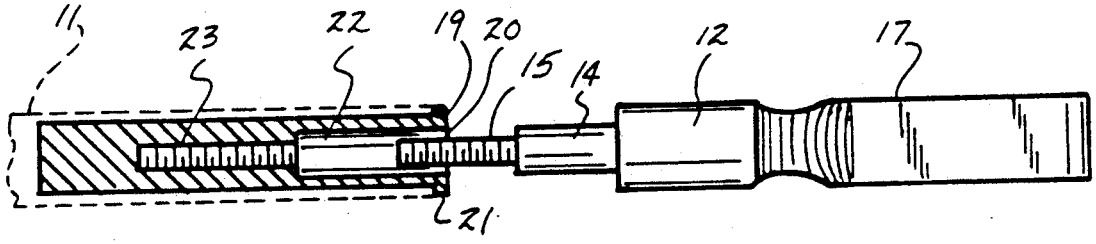
FIG. 4

FIG. 5
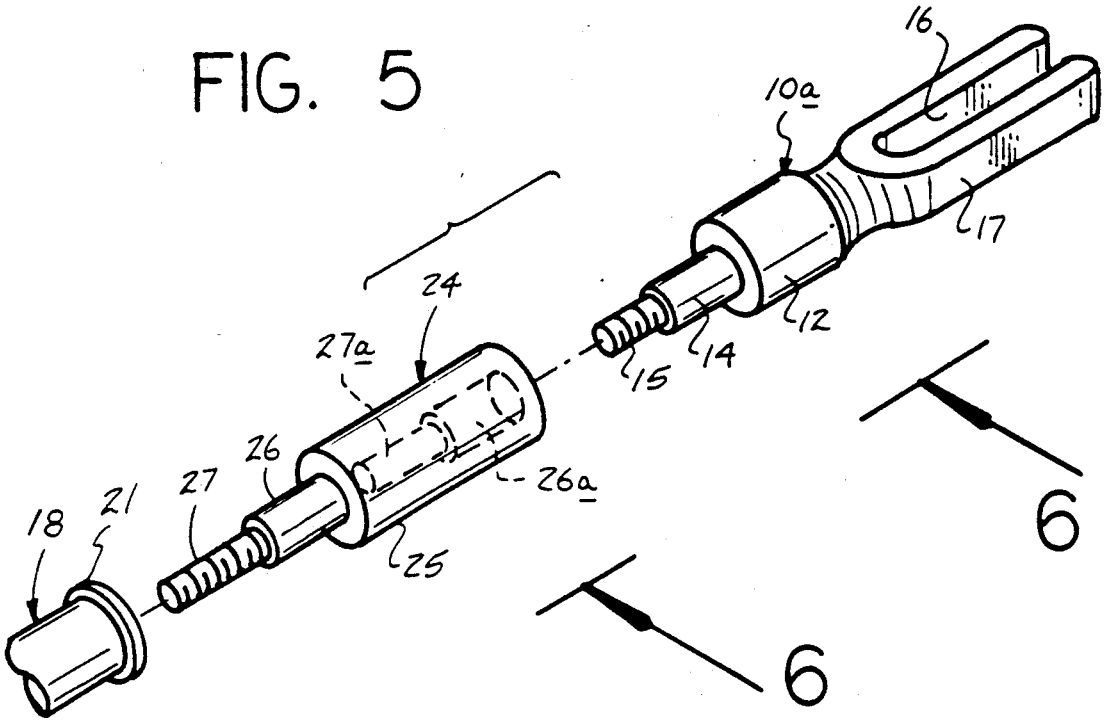
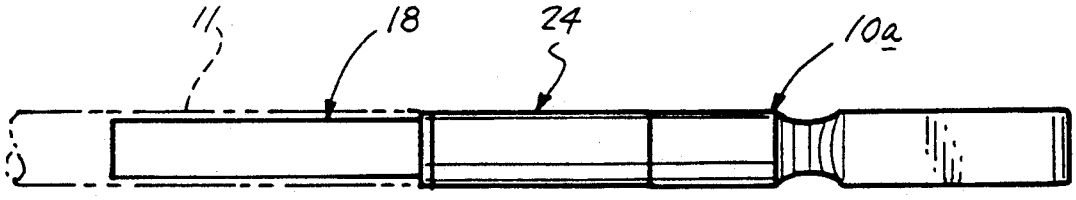
FIG. 6

ARROW NOCK ASSEMBLY

BACKGROUND OF THE INVENTION

1. Field of the Invention

The field of invention relates to arrow nock structure, and more particularly pertains to a new and improved arrow nock assembly wherein the same is arranged for mounting to a rearward distal end of an arrow shaft.

2. Description of the Prior Art

Nock structure of various types have been utilized throughout the prior art and exemplified by the U.S. Pat. Nos. 4,645,211; 4,305,588; 3,749,076; U.S. Design patent No. 301,272; and U.S. Pat. No. 4,544,163.

The instant invention attempts to overcome deficiencies of the prior art by providing for the installation of a nock assembly, wherein the same is arranged for mounting to an associated rear distal end of an arrow in a coaxially aligned relationship, as well as employing an extension structure as optionally desired thereto and in this respect, the present invention substantially fulfills this need.

SUMMARY OF THE INVENTION

In view of the foregoing disadvantages inherent in the known types of arrow nock structure now present in the prior art, the present invention provides an arrow nock assembly wherein the same is arranged for mounting in a coaxially aligned relationship to an arrow structure. As such, the general purpose of the present invention, which will be described subsequently in greater detail, is to provide a new and improved arrow nock assembly which has all the advantages of the prior art arrow nock structure and none of the disadvantages.

To attain this, the present invention provides an arrow arranged to threadedly receive a nock member, wherein the nock member is threadedly received within an associated insert coaxially positioned within the rearward distal end of the associated arrow shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved arrow nock assembly which has all the advantages of the prior art arrow nock structure and none of the disadvantages.

It is another object of the present invention to provide a new and improved arrow nock assembly which may be easily and efficiently manufactured and marketed.

It is a further object of the present invention to provide a new and improved arrow nock assembly which is of a durable and reliable construction.

An even further object of the present invention is to provide a new and improved arrow nock assembly which is susceptible of a low cost of manufacture with regard to both materials and labor, and which accordingly is then susceptible of low prices of sale to the consuming public, thereby making such arrow nock assemblies economically available to the buying public.

Still yet another object of the present invention is to provide a new and improved arrow nock assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the assembly employing the arrow insert in association with the nock member.

FIG. 4 is an orthographic view, taken along the lines 4—4 of FIG. 3 in the direction indicated by the arrows.

FIG. 5 is an isometric illustration of the invention emloying an extension member.

FIG. 6 is an orthographic view, taken along the lines 6—6 of FIG. 5 in the direction indicated by the arrows.

DESCRIPTION OF THE PREFERRED EMBODIMENT

Figure 1:
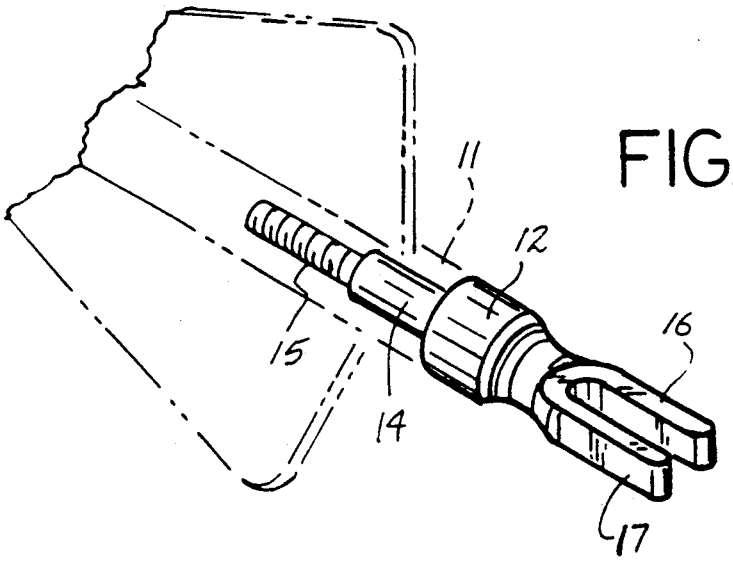
FIG. 1 is an isometric illustration of the arrow nock member mounted to an associated arrow shaft.
Figure 2:
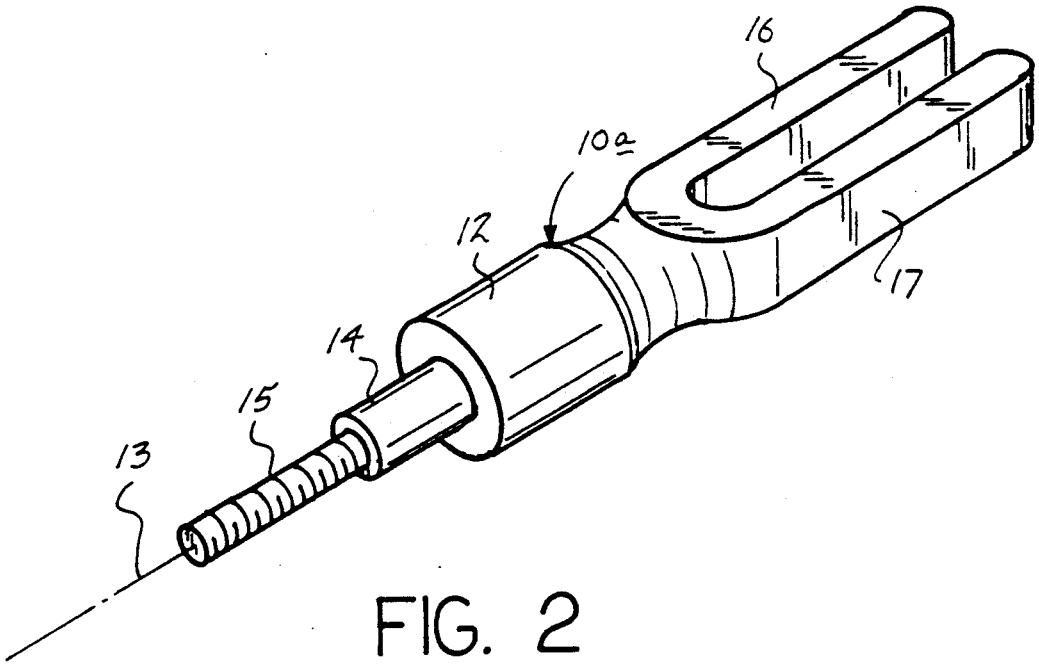
FIG. 2 is an isometric illustration of the nock member.

With reference now to the drawings, and in particular to FIGS. 1 to 8 thereof, a new and improved arrow nock assembly embodying the principles and concepts of the present invention and generally designated by the reference numeral 10 will be described.

More specifically, the arrow nock assembly 10 of the instant invention essentially comprises a nock member 10*a* arranged for mounting to an associated arrow 11 at its rear distal end coaxially aligned about an axis 13. The nock member 10*a* includes a cylindrical head 12 having a predetermined first diameter substantially equal to an arrow diameter equal to said predetermined first diameter to align the cylindrical head relative to the arrow 11 in use. A shank 14 is coaxially and integrally mounted to the cylindrical head 12 extending therefrom, having an externally threaded mounting rod 15 coaxially directed from the shank 14 projecting beyond the cylindrical head, wherein the shank is of a second diameter less than said first diameter, and the mounting rod 15 is of a third diameter less than said second diameter. First and second legs 16 and 17 are arranged in a parallel relationship and mounted symmetrically and coaxially of the nock member 10*a*, with the first and second legs 16 and 17 projecting beyond an opposed side of the cylindrical head 12 relative to the shank and mounting rod 14 and 15 respectively.

The FIGS. 3 and 4 indicate the use of an insert sleeve 18 coaxially mounted within the rearward end portion of the arrow 11, with the insert sleeve 18 having a cylindrical body including an entrance end 19 providing an entrance end opening 20 in communication with a first cylindrical cavity 22 arranged for complementarily receiving the shank 14, while the first cylindrical cavity 22 is in communication with the second cylindrical cavity 23 arranged to threadedly and complementarily receive the mounting rod 15. An annular flange 21 extends about the entrance end 19 for abutment with the rearward end portion of the arrow 11, as indicated in FIG. 4.

The FIG. 5 includes the use of an extension member 24, if desired, to provide for adjustment of length of the associated arrow structure in use. The extension member 24 includes an extension member cylindrical body 25 having said predetermined first diameter, with the extension member having an extension member first cylindrical boss 26, having a diameter equal to said second diameter and complementarily received within the first cylindrical cavity 22 of the insert sleeve 18. An extension member second cylindrical boss 27 externally threaded is complementarily and threadedly received within the second cylindrical cavity 23 of the insert sleeve 18.

Figure 7:
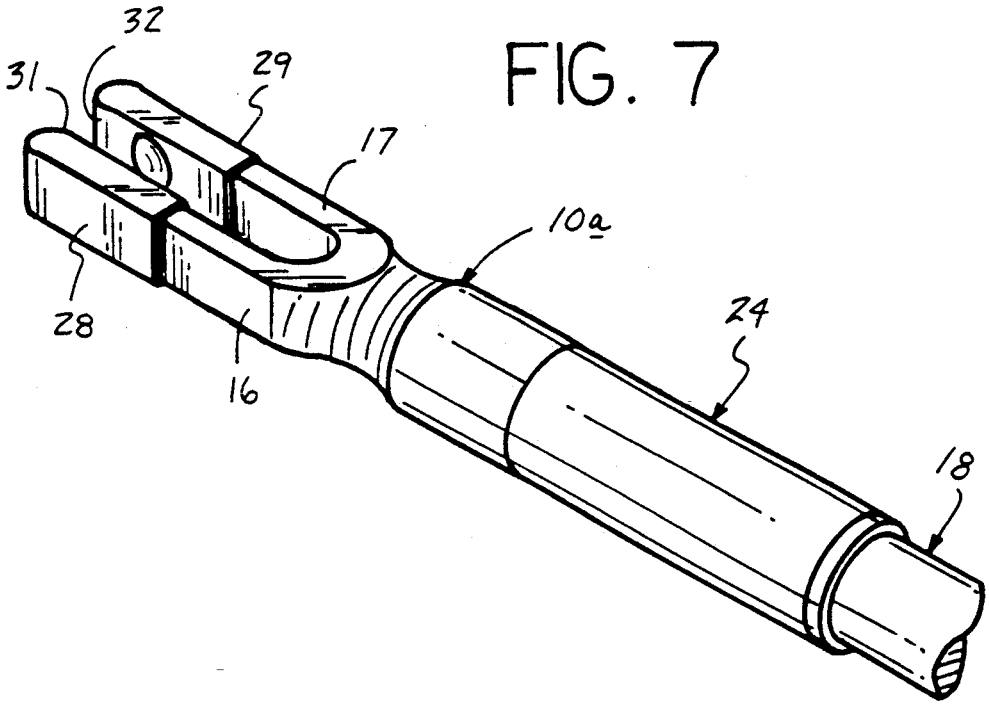
FIG. 7 is an isometric illustration of the invention employing sleeve members to the legs of the nock structure.
Figure 8:
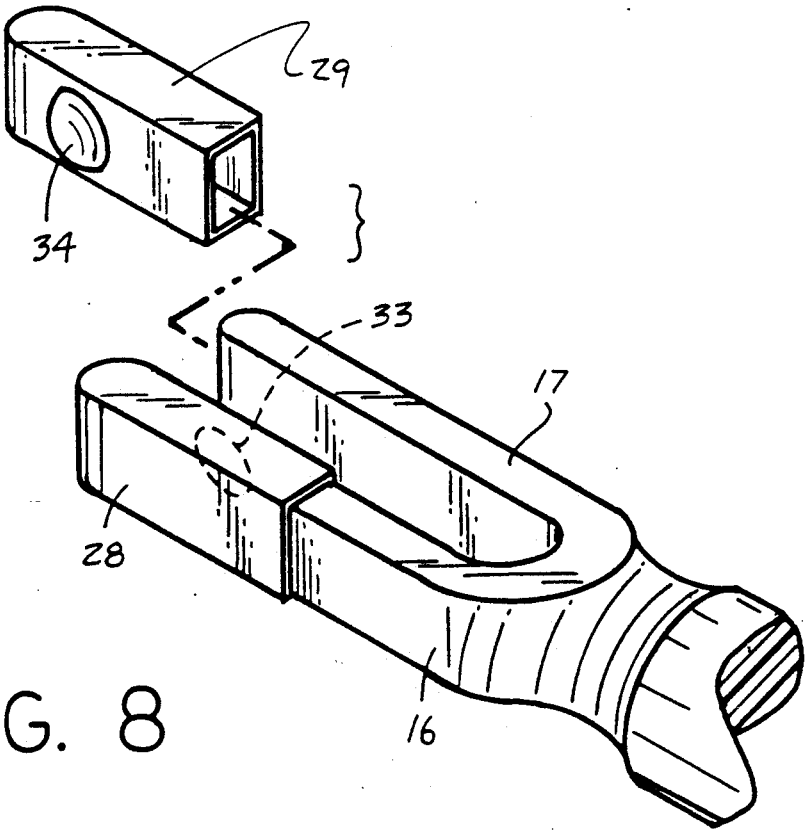
FIG. 8 is an enlarged isometric illustration of the sleeve structure arranged for mounting relative to the legs of the nock member.

The FIGS. 7 and 8 indicate optional employment of first and second tubular sleeves 28 and 29 respectively arranged for respective mounting to the respective first and second legs 16 and 17. The first and second sleeves 28 and 29 are preferably formed of resilient material to engage and permit securement to the first and second legs 16 and 17 while alternatively the sleeves may be of rigid material and adhesively or mechanically secured to the first and second legs. The first and second tubular sleeves 28 and 29 have respective first and second facing walls 31 and 32 arranged in a coextensive facing relationship relative to one another upon the legs 16 and 17 respectively, with the first and second walls 31 and 32 having respective first and second projections 33 and 34 in a facing complementary relationship relative to one another of a generally arcuate convex configuration to accommodate, as desired, various thicknesses of bow strings in use permitting the organization to accommodate various bows in use.

With reference to the insert sleeve, it should be noted that the insert sleeve includes an insert sleeve first cavity 26*a* arranged to complementarily receive the shank 14, with an insert sleeve second cavity arranged to threadedly and complementarily receive the mounting rod 15. Accordingly, the insert sleeve first and second cylindrical cavities 26*a* and 27*a* respectively are in communication relative to one another and coaxially aligned along the aforenoted predetermined axis 13 when in use, in a manner as indicated in FIGS. 5 and 6.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An arrow nock assembly, comprising, a nock member having a cylindrical head of a first diameter, the cylindrical head including a cylindrical head first end and a cylindrical head second end, with the cylindrical head first end having a shank extending therefrom of a second diameter less than the first diameter, with an externally threaded mounting rod coaxially aligned relative to the shank extending therefrom of externally threaded configuration of a third diameter less than said second diameter, and second legs arranged in a spaced relationship mounted to the cylindrical head integrally at the second end, with the cylindrical head, the first leg, the second leg, the shank, and the mounting rod coaxially aligned along a predetermined axis in a symmetrical configuration, and an insert sleeve, the insert sleeve having a sleeve entrance end, with the sleeve including an entrance end opening, and a first cylindrical cavity directed into the insert sleeve coaxially of the insert sleeve, with the first cylindrical cavity arranged to complementarily receive the shank therewithin, and a second cylindrical sleeve in communication with the first cylindrical sleeve arranged to threadedly engage and receive in a complementary relationship the mounting rod, and the entrance end includes an annular flange oriented coaxially of the insert sleeve projecting laterally thereof, and an extension member, the extension member having an extension member cylindrical body, having a cylindrical body diameter equal to said first diameter, with the extension member including an extension member first cylindrical boss arranged for selective threaded reception within the first cylindrical cavity, and the extension member further including an extension member second cylindrical boss arranged to threadedly engage the second cylindrical cavity, and the extension member further including an extension member first cavity arranged to threadedly receive the shank, and an extension member second cavity arranged to threadedly receive in a complementary relationship the mounting rod, and a first tubular sleeve mounted upon the first leg, and a second tubular sleeve mounted upon the second leg, the first tubular sleeve includes a first facing wall, the second tubular sleeve includes a second facing wall, the first facing wall includes a first projection, the second facing wall includes a second projection, with the first projection and the second projection arranged in a mirror image relationship relative to one another when mounted upon the first leg and the second leg respectively.

2. A nock assembly as set forth in claim 1 wherein the first tubular sleeve is resilient, and the second tubular sleeve is resilient.

* * * * *